US009957962B2

(12) United States Patent
Choi et al.

(10) Patent No.: US 9,957,962 B2
(45) Date of Patent: May 1, 2018

(54) SCROLL COMPRESSOR

(71) Applicant: LG ELECTRONICS INC., Seoul (KR)

(72) Inventors: Yoonsung Choi, Seoul (KR); Byungkil Yoo, Seoul (KR); Jinho Kim, Seoul (KR); Byeongchul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 112 days.

(21) Appl. No.: 14/939,327

(22) Filed: Nov. 12, 2015

(65) Prior Publication Data

US 2016/0146206 A1 May 26, 2016

(30) Foreign Application Priority Data

Nov. 21, 2014 (KR) ..... 10-2014-0163111

(51) Int. Cl.

| | |
|---|---|
| ***F03C 2/02*** | (2006.01) |
| ***F01C 1/04*** | (2006.01) |
| ***F01C 1/063*** | (2006.01) |
| ***F04C 2/04*** | (2006.01) |
| ***F04C 18/04*** | (2006.01) |
| ***F04C 18/02*** | (2006.01) |
| *F04C 23/00* | (2006.01) |

(52) U.S. Cl.
CPC ..... *F04C 18/0215* (2013.01); *F04C 18/0269* (2013.01); *F04C 23/008* (2013.01)

(58) Field of Classification Search
CPC ..... F04C 18/0215; F04C 18/0269
USPC ..... 418/55.1–55.6, 150
See application file for complete search history.

(56) References Cited

U.S. PATENT DOCUMENTS 5,775,893 A * 7/1998 Takao ..... F01C 17/066 418/151
5,938,417 A * 8/1999 Takao ..... F04C 18/0246 418/55.2

(Continued)

FOREIGN PATENT DOCUMENTS

CN 1138669 12/1996
CN 1157883 8/1997

(Continued)

OTHER PUBLICATIONS

English machine translation JP59063389 to Machida et al by J-Piat Pat Aug. 9, 2017.*

(Continued)

*Primary Examiner* — Mark Laurenzi
*Assistant Examiner* — Deming Wan
(74) *Attorney, Agent, or Firm* — Ked & Associates LLP

(57) ABSTRACT

A scroll compressor is provided that may include a casing including a rotational shaft, a first scroll rotated by rotation of the rotational shaft, the first scroll including a first head plate and a first wrap that extends from the first head plate in a first direction, and a second scroll that defines a plurality of compression chambers together with the first scroll, the second scroll including a second head plate and a second wrap that extends from the second head plate in a second direction. Each of the first and second wraps spirally may extend from an outer end toward an inner start end, and the first wrap may have a thickness greater than a thickness of the second wrap.

6 Claims, 9 Drawing Sheets

(56) References Cited

U.S. PATENT DOCUMENTS

| | | | | |
|---|---|---|---|---|
| 6,224,357 | B1 * | 5/2001 | Komai | F01C 21/102 418/55.2 |
| 8,313,318 | B2 * | 11/2012 | Stover | F04C 18/0215 417/299 |
| 2010/0111739 | A1 * | 5/2010 | Murakami | F04C 18/0215 418/55.1 |
| 2013/0004354 | A1 * | 1/2013 | Kiem | F04C 18/0215 418/55.2 |

FOREIGN PATENT DOCUMENTS

| | | | | |
|---|---|---|---|---|
| CN | 102089524 | | 6/2011 | |
| JP | 59063389 | A * | 4/1984 | F01C 1/0246 |
| KR | 10-2000-0074285 | | 6/2002 | |

OTHER PUBLICATIONS

Chinese Office Action dated Jun. 16, 2017 (English Translatiion).

* cited by examiner

SCROLL COMPRESSOR

CROSS-REFERENCE TO RELATED APPLICATION(S)

The present application claims priority under 35 U.S.C. 119 and 35 U.S.C. 365 to Korean Patent Application No. 10-2014-0163111, filed in Korea on Nov. 21, 2014, which is hereby incorporated by reference in its entirety.

BACKGROUND

1. Field

A scroll compressor is disclosed herein.

2. Background

A scroll compressor is a compressor that utilizes a fixed scroll having a fixed wrap and an orbiting scroll that revolves with respect to the fixed scroll and having an orbiting wrap. That is, a scroll compressor is a compressor in which the fixed scroll and the orbiting scroll are engaged with each other to revolve, thereby reducing a volume of a compression chamber, which is formed between the fixed scroll and an orbiting scroll according to an orbiting motion of the orbiting scroll, and thus, increasing in pressure a fluid and discharging the fluid through a discharge hole formed in or at a central portion of the fixed scroll. Such a scroll compressor has a feature in which suction, compression, and discharge of a fluid are successively performed while the orbiting scroll revolves. Accordingly, a discharge valve and suction valve may be unnecessary in principle.

As a number of parts forming the scroll compressor is less in comparison to other types of compressors, the scroll compressor may be simplified in structure and rotate at a high speed. Also, as a variation in torque required for compression is less in comparison to other types of compressors, and suction and compression successively occur, a relatively small amount of noise and vibration may occur.

Behavior characteristics of the scroll compressor may be determined by shapes of the fixed wrap and the orbiting wrap. Each of the fixed wrap and the orbiting wrap may have a predetermined shape. Further, each of the fixed wrap and the orbiting wrap may have an involute curve having a uniform thickness. The involute curve may be a curve corresponding to a trajectory which is drawn by an end of a thread when the thread wound around a basic circle having a predetermined radius is unwound. The present applicant has filed for a patent application (hereinafter, referred to as a "related art") with respect to a scroll compressor having an involution curve type wrap, Korean Application No. 10-2000-0074285, filed in Korea on Dec. 7, 2000 and entitled "Scroll Compressor", which is hereby incorporated by reference.

If a wrap having the involute curve shape is used as in the related art, as each of the fixed wrap and the orbiting wrap has a uniform thickness, each of the fixed wrap and the orbiting wrap may have a uniform capacity variation. Thus, it may be difficult to obtain a high compression ratio.

Although a winding number of the fixed wrap or the orbiting wrap may be increased to obtain a high compression ratio, if the winding number of the fixed wrap or the orbiting wrap increases, the scroll compressor may also increase in size. Also, if the fixed wrap or the orbiting wrap increases in height, a ratio of height to thickness of the wrap may increase, reducing wrap strength, thereby deteriorating reliability.

BRIEF DESCRIPTION OF THE DRAWINGS

Embodiments will be described in detail with reference to the following drawings in which like reference numerals refer to like elements, and wherein.

DETAILED DESCRIPTION

Figure 1:
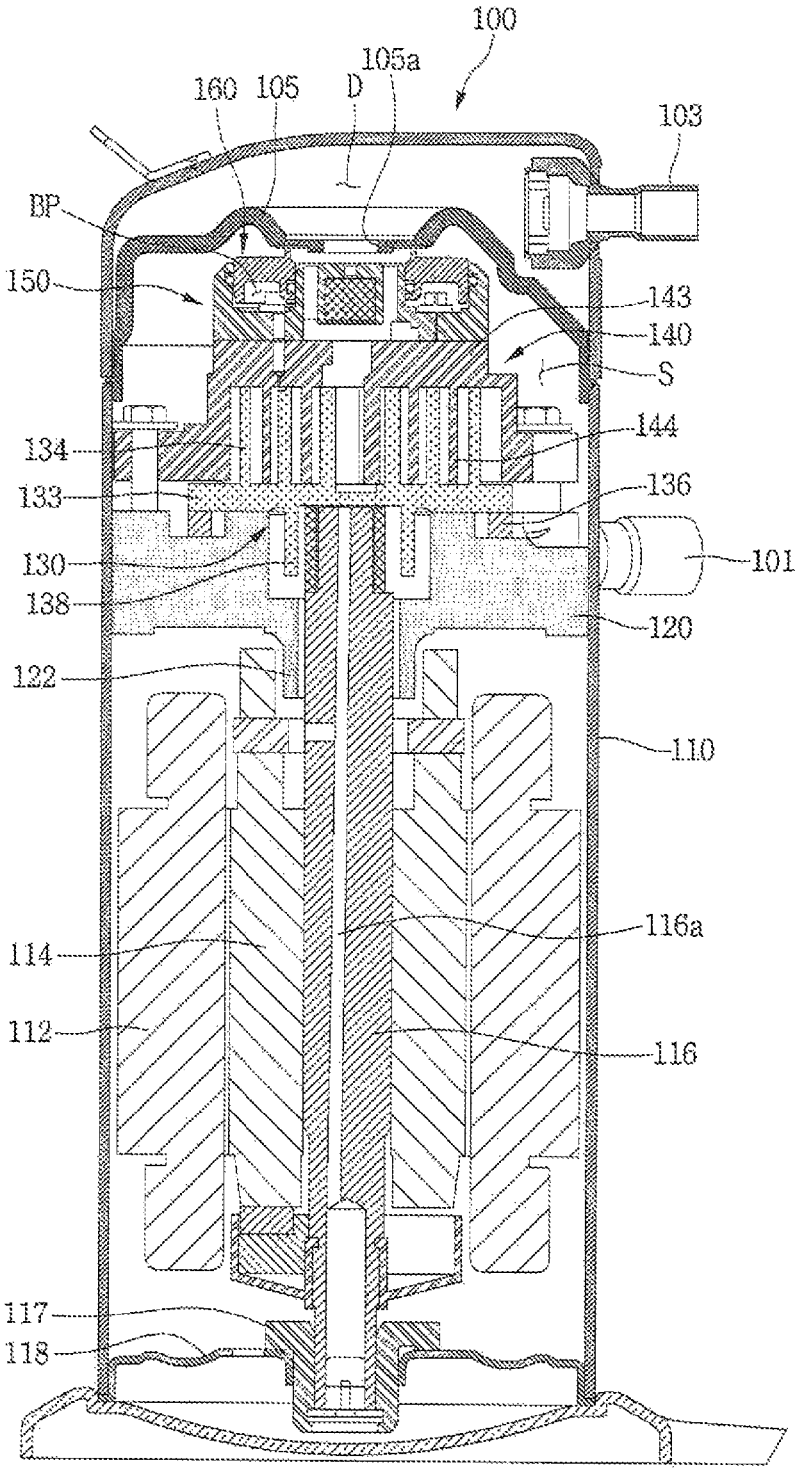
FIG. 1 is a cross-sectional view of a scroll compressor according to an embodiment.
Figure 2:
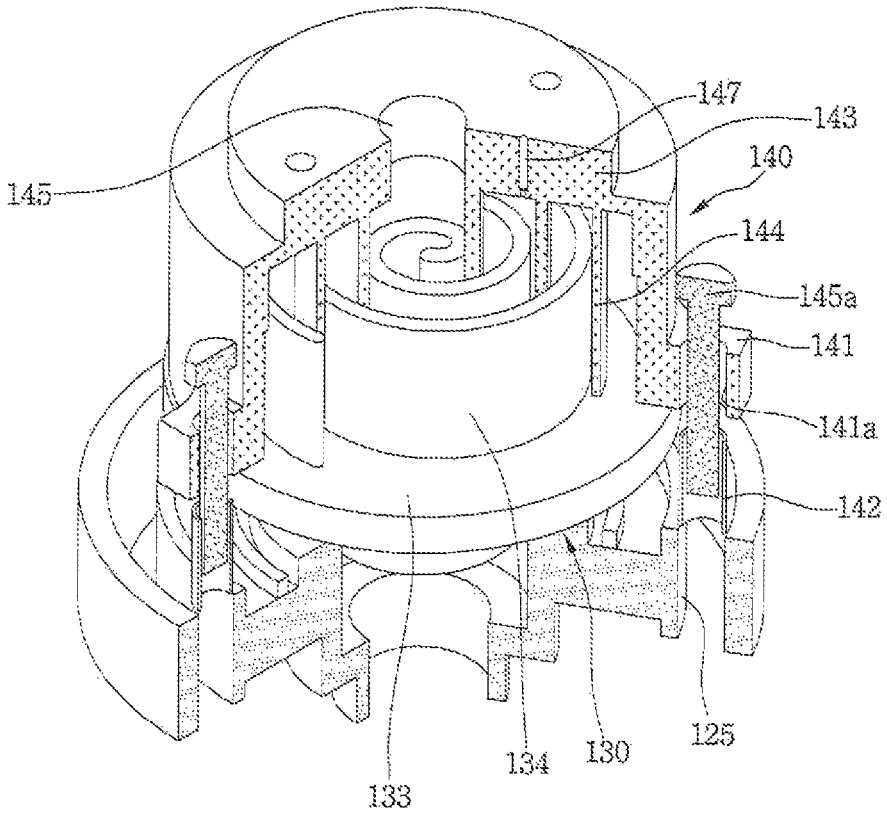
FIG. 2 is a partial exploded cross-sectional view of the scroll compressor according to an embodiment.

FIG. 1 is a cross-sectional view of a scroll compressor according to an embodiment. FIG. 2 is a partial exploded cross-sectional view of the scroll compressor according to an embodiment.

Referring to FIGS. 1 and 2, a scroll compressor 100 according to an embodiment may include a casing 110 that defines a suction space S and a discharge space D. A discharge cover 105 may be provided in an inner upper portion of the casing 110. An inner space of the casing 110 may be partitioned into the suction space S and the discharge space D by the discharge cover 105. An upper side of the discharge cover 105 may correspond to the discharge space D, and a lower side of the discharge cover 105 may correspond to the suction space S. A discharge hole 105*a*, through which a refrigerant compressed to a high pressure may be discharged, may be defined in an approximately central portion of the discharge cover 105.

The scroll compressor 100 may further include a suction port 101 that communicates with the suction space S and a discharge port 103 that communicates with the discharge space D. Each of the suction port 101 and the discharge port 103 may be fixed to the casing 101 to allow the refrigerant to be suctioned into the casing 110 or discharged outside of the casing 110.

A motor may be provided on or at a lower portion of the suction space S. The motor may include a stator 112 coupled to an inner wall of the casing 110, a rotor 114 rotatably provided within the stator 112, and a rotational shaft 116 that passes through a central portion of the stator 114.

A lower portion of the rotational shaft 116 may be rotatably supported by an auxiliary bearing 117 provided on or at a lower portion of the casing 110. The auxiliary bearing 117 may be coupled to a lower frame 118 to stably support the rotational shaft 116.

The lower frame 118 may be fixed to the inner wall of the casing 110, and a bottom surface of the casing 110 may be used as an oil storage space. Oil stored in the oil storage space may be transferred upward by an oil supply passage 116*a* defined in the rotational shaft 116, and then, may be uniformly supplied into the casing 110. The oil supply passage 116*a* may be eccentrically provided toward any one side so that oil introduced into the oil supply passage 116*a* may flow upward by a centrifugal force generated by rotation of the rotational shaft 116.

An upper portion of the rotational shaft 116 may be rotatably supported by a main frame 120. The main frame 120 may be fixed to the inner wall of the casing 110, similar to the lower frame 118. A main bearing 122 that protrudes downward may be provided on or at a bottom surface of the main frame 120. The rotational shaft 116 may be inserted into the main bearing 122. An inner wall of the main bearing 122 may function as a bearing surface so that the rotational shaft 116 may smoothly rotate.

An orbiting scroll 130 may be provided on a top surface of the main frame 120. The orbiting scroll 130 may include a first head plate 133 having an approximately disk shape and placed on the main frame 120, and an orbiting wrap 134 having a spiral shape and extending from the first head plate 133. The first head plate 133 may define a lower portion of the orbiting scroll 130 and function as a main body of the orbiting scroll 130, and the orbiting wrap 134 may extend upward from the first head plate 133 to define an upper portion of the orbiting scroll 130. The orbiting wrap 134 together with a fixed wrap 144, which will be described hereinafter, of a fixed scroll 140 may define a compression chamber. The orbiting scroll 130 may be referred to as a "first scroll", and the fixed scroll 140 may be referred to as a "second scroll".

The first head plate 133 of the orbiting scroll 130 may revolve in a state in which the first head plate 133 is supported on the top surface of the main frame 120. An Oldham ring 136 may be provided between the first head plate 133 and the main frame 120 to prevent the orbiting scroll 130 from revolving. A boss 138, into which the upper portion of the rotational shaft 116 may be inserted, may be provided on a bottom surface of the first head plate 133 of the orbiting scroll 130 to easily transmit a rotational force of the rotational shaft 116 to the orbiting scroll 130.

The fixed scroll 140 engaged with the orbiting scroll 130 may be provided on the orbiting scroll 130. The fixed scroll 140 may include a plurality of pin supports 141 that protrudes from an outer circumferential surface of the fixed scroll 140 and each of which may have a guide hole 141*a*, a guide pin 142 inserted into the guide hole 141*a* and provided on the top surface of the main frame 120, and a coupling member 145*a* inserted into the guide pin 142 and fitted into an insertion hole 125 of the main frame 120.

The fixed scroll 140 may include a second head plate 143 having a disk shape and the fixed wrap 144 that extends from the second head plate 143 toward the first head plate 133 and engaged with the orbiting wrap 134 of the orbiting scroll 130. The second head plate 143 may define an upper portion of the fixed scroll 140 and function as a main body of the fixed scroll 140, and the fixed wrap 144 may extend downward from the second head plate 143 to define a lower portion of the fixed scroll 140. For convenience of description, the orbiting wrap 134 may be referred to as a "first wrap", and the fixed wrap may be referred to as a "second wrap".

An end of the fixed wrap 144 may contact the first head plate 133, and an end of the orbiting wrap 134 may contact the second head plate 143. A length by which the orbiting wrap 134 extends from the first head plate 133 to the second head plate 143 may be equal to a length by which the fixed wrap 144 extends from the second head plate 143 to the first head plate 133. The length may be referred to as a "height" of the wrap in a vertical direction.

The fixed wrap 144 may extend in a predetermined spiral shape, and a discharge hole 145, through which compressed refrigerant may be discharged, may be defined in an approximately central portion of the second head plate 143. A suction hole (not shown), through which the refrigerant within the suction space S, may be suctioned, may be defined in a side surface of the fixed scroll 140. The refrigerant suctioned in through the suction hole may be introduced into the compression chamber defined by the orbiting wrap 134 and the fixed wrap 144.

The fixed wrap 144 and the orbiting wrap 134 may define a plurality of compression chambers. Each of the plurality of compression chambers may be reduced in volume while revolving and moving toward the discharge hole 145 to compress the refrigerant. Thus, a compression chamber adjacent to the suction hole may be minimized in pressure, and a compression chamber that communicates with the discharge hole 145 may be maximized in pressure. A compression chamber between the above-described compression chambers may have an intermediate pressure that corresponds to a pressure between a suction pressure of the suction hole and a discharge pressure of the discharge hole 145. The intermediate pressure may be applied to a back pressure chamber BP to press the fixed scroll 140 toward the orbiting scroll 130.

An intermediate pressure discharge hole 147 that transfers the refrigerant of the compression chamber having the intermediate pressure to the back pressure chamber BP may be defined in the second head plate 143 of the fixed scroll 140. That is, the intermediate pressure discharge hole 147 may be defined in a portion of the fixed scroll 130 at which the pressure in the compression chamber that communicates with the intermediate pressure discharge hole 147 is greater than the pressure in the suction space S and less than the pressure in the discharge space D. The intermediate pressure discharge hole 147 may pass from a top surface to a bottom surface of the second head plate 143.

A back pressure chamber assembly 150 and 160 that defines the back pressure chamber may be provided on the fixed scroll 140. The back pressure chamber assembly 150 and 160 may include a back pressure plate 150 provided on an upper portion of the second head plate 143, and a floating plate 160 separably coupled to the back pressure plate 150 to move in a vertical direction. The back pressure chamber BP may be defined as an inner space of the back pressure plate 150 and the floating plate 160.

Each of the orbiting wrap 134 and the fixed wrap 144 may have a logarithmic spiral shape. The logarithmic spiral shape may represent a spiral curved shape having a thickness that gradually increases in thickness from an outer end toward an inner start end of each of the wraps 134 and 144. The outer end may refer to a side into which the refrigerant may be suctioned, that is, an end at a side of the suction hole, and the inner start end may be refer to a side from which the refrigerant may be discharged, that is, an end at a side of the discharge hole 145.

The outer end of the orbiting wrap 134 according to an embodiment may have a thickness greater than a thickness of the fixed wrap 144. Hereinafter, descriptions relating to the above-described structure will be described with reference to the accompanying drawings.

Figure 3:
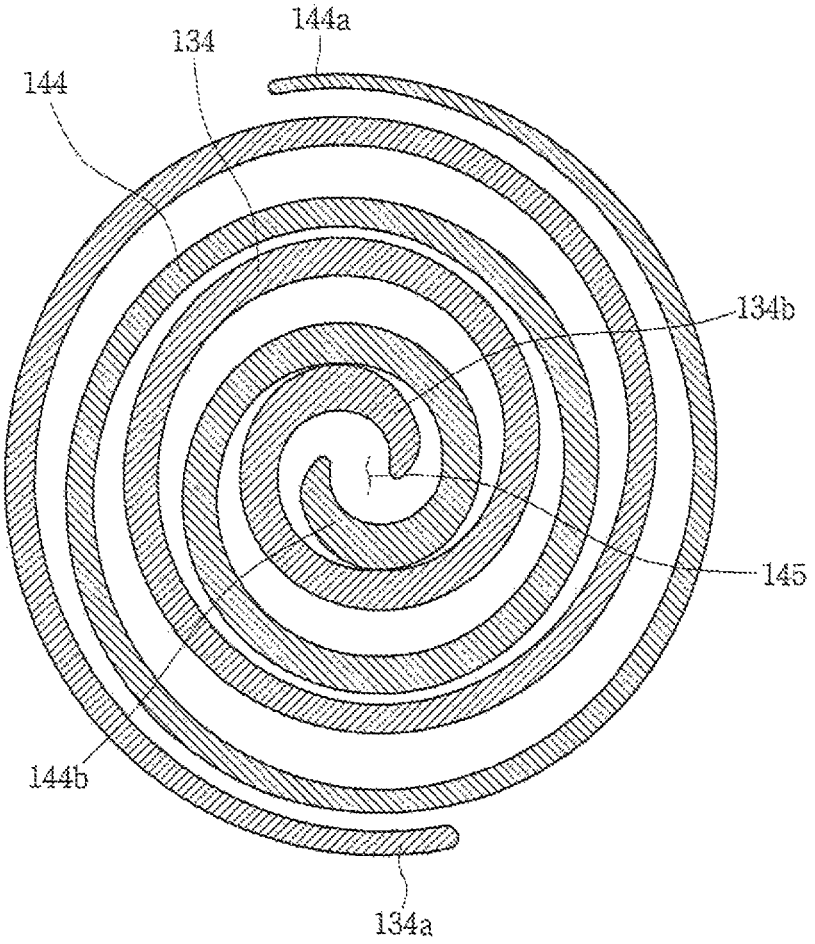
FIG. 3 is a view illustrating a first wrap of an orbiting scroll and a second wrap of a fixed scroll according to an embodiment.
Figure 4A:
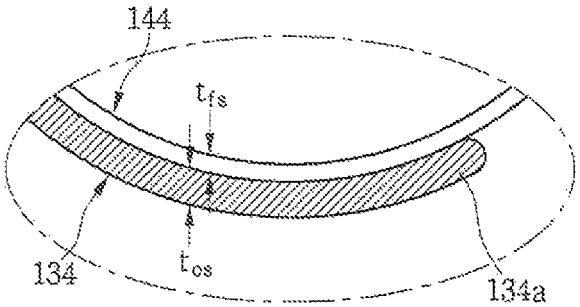
FIGS. 4A and 4B views illustrating a state in which the first wrap is increased in length when the first wrap of the orbiting scroll has a thickness thicker than a thickness of the second wrap of the fixed scroll according to an embodiment.
Figure 4B:
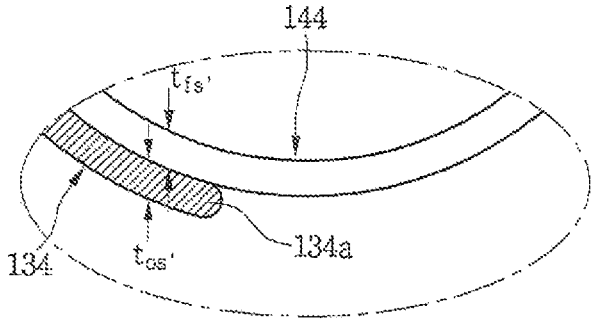
Figure 5:
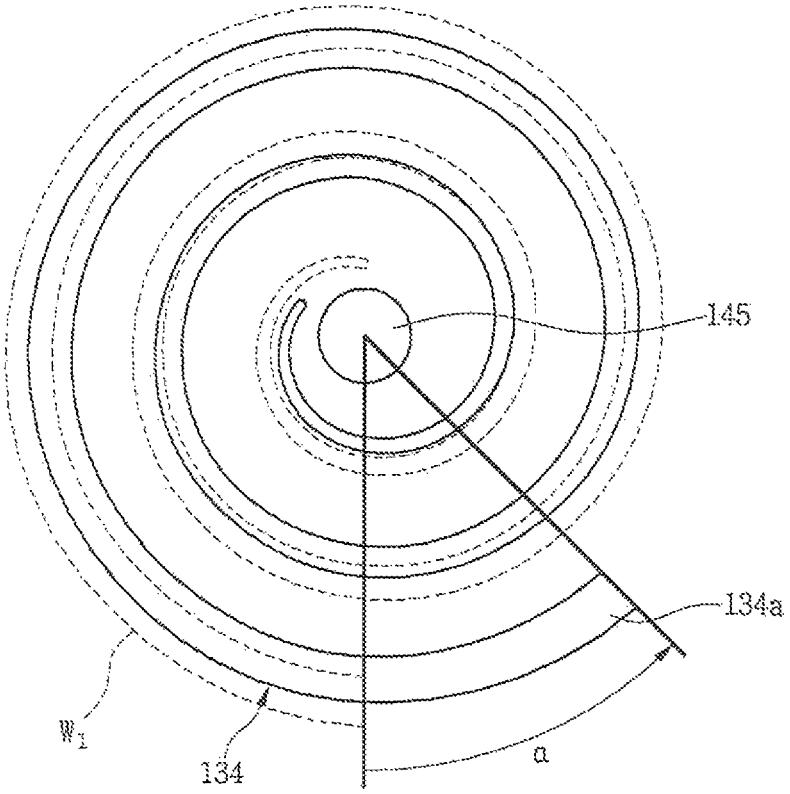
FIG. 5 is a view illustrating a state in which the first wrap of the orbiting scroll is increased in wrap angle according to an embodiment in comparison to the related art.
Figure 6:
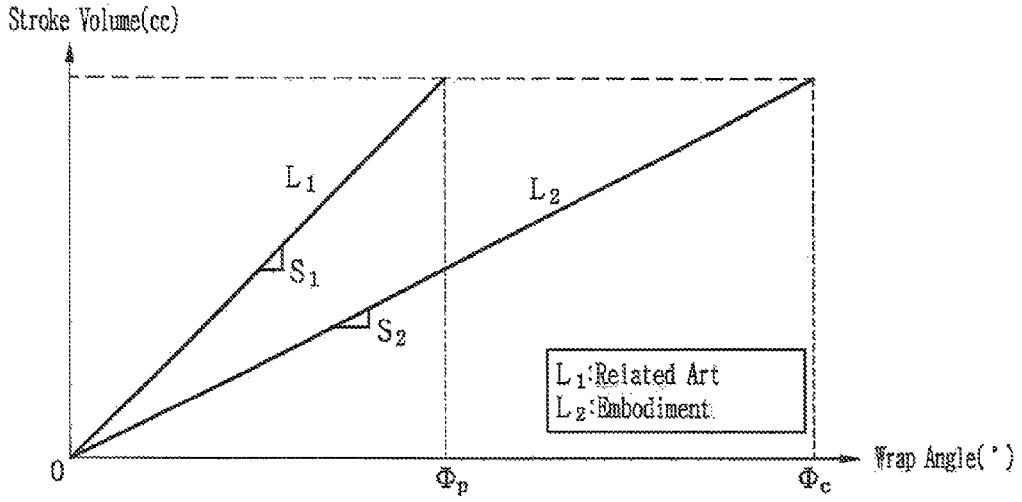
FIG. 6 is a graph illustrating a state in which an increasing gradient of a stroke volume decreases when the wrap angle increases according to an embodiment in comparison to the related art.

FIG. 3 is a view illustrating a first wrap of an orbiting scroll and a second wrap of a fixed scroll according to an embodiment. FIGS. 4A and 4B views illustrating a state in which the first wrap is increased in length when the first wrap of the orbiting scroll has a thickness thicker than a thickness of the second wrap of the fixed scroll according to an embodiment. FIG. 5 is a view illustrating a state in which the first wrap of the orbiting scroll is increased in wrap angle according to an embodiment in comparison to the related art. FIG. 6 is a graph illustrating a state in which an increasing gradient of a stroke volume decreases when the wrap angle increases according to an embodiment in comparison to the related art.

Referring to FIG. 3, the orbiting wrap 134 and the fixed wrap 144 according to an embodiment may extend from the inner start end toward the outer end in a counterclockwise direction. Each of the orbiting wrap 134 and the fixed wrap 144 may have a thickness that gradually increases from the outer end toward the inner start end thereof due to the logarithmic spiral shape. The outer ends may represent an end provided at a suction side for the refrigerant of both ends of each of the orbiting wrap 134 and the fixed wrap 144, and the inner start end may represent an end provided at a discharge side for the refrigerant.

An outer end 134*a* of the orbiting wrap 134 may have a thickness greater than a thickness of an outer end 144*a* of the fixed wrap 144. Also, the inner start end 134*b* of the orbiting wrap 134 may have a thickness equal or similar to a thickness of the inner start end 144*b* of the fixed wrap 144. That is, the orbiting wrap 134 may have a thickness greater than a thickness of the fixed wrap 144 at a position at which the orbiting wrap 134 and the fixed wrap 144 correspond to each other. The corresponding position may refer to a position at which rotating amounts (angles) of the orbiting wrap 134 and the fixed wrap 144 from the inner start ends to the outer ends are the same.

To increase a compression capacity of the scroll compressor, it is necessary to increase a compression space defined by the orbiting wrap 134 and the fixed wrap 144. For this, for example, each of the orbiting wrap 134 and the fixed wrap 144 may be increased in height. The term "height" may represent a vertical length in FIG. 1.

When each of the wraps 134 and 144 is increased in height with respect to a predetermined thickness, a strength of each of the wraps 134 and 144 may be weakened. That is, when the scroll compressor is driven, the wraps 134 and 144 may be damaged by a force that acts on the wraps 134 and 144, deteriorating reliability. In particular, although the strength of the fixed wrap 144 of the fixed scroll 140, which may be stably supported by the main frame 120, may not be a big problem, the strength of the orbiting wrap 134 of the orbiting scroll 130, which may be rotatably supported on the upper portion of the rotational shaft 116, may be weakened.

Thus, it may be necessary to maintain the orbiting wrap 134 at a predetermined thickness or more. That is, it may be necessary to maintain the outer end 134*a*, that is, a thinnest portion of the orbiting wrap 134, at a predetermined thickness or more.

On the other hand, when the fixed wrap 144 and the orbiting wrap 134 have a same thickness, that is, each of the fixed wrap 144 and the orbiting wrap 134 has a predetermined thickness or more, the plurality of compression chambers defined by the orbiting wrap 134 and the fixed wrap 144 may be reduced in size by sizes corresponding to thicknesses of the orbiting wrap 134 and the fixed wrap 144, reducing an amount of discharged refrigerant.

When the orbiting scroll 130 rotates, the orbiting wrap 134 and the fixed wrap 144 may selectively contact each other at a plurality of points. A sum of the thicknesses of the wraps 134 and 144 at the plurality of contact points has to be uniformly maintained.

However, when the fixed wrap 144 has the predetermined thickness or more as described above, the orbiting wrap 134 may be relatively reduced in thickness. Thus, when considering the logarithmic spiral shape, the orbiting wrap 134 may not be extended in length. This is done because it is necessary to maintain the thickness of the outer end 134*a* of the orbiting wrap 134 to a predetermined value or more so as to improve the strength of the orbiting wrap 134 as described above.

FIG. 4B illustrates a case in which a thickness $t_{fs}'$ of the fixed wrap 144 is equal to a thickness $t_{os}'$ of the orbiting wrap 134. That is, FIG. 4B illustrates a case in which the fixed wrap 144 has a relatively large thickness $t_{fs}'$.

On the other hand, FIG. 4A illustrates a case in which a thickness $t_{fs}$ of the fixed wrap 144 is less than a thickness $t_{os}$ of the orbiting wrap 134. That is, the fixed wrap 144 has the thickness $t_{fs}$ less than the thickness $t_{fs}'$ of the fixed wrap 144 of FIG. 4B, and the orbiting wrap 134 has the thickness $t_{os}$ greater than that $t_{os}'$ of the orbiting wrap 134 of FIG. 4B ($t_{fs}<t_{fs}'$, $t_{os}>t_{os}'$).

As a result, it is necessary that the outer end 134*a* of the orbiting wrap 134 has a predetermined thickness or more. When considering the logarithmic spiral shape having a thickness that gradually increases toward the inner start end, if the orbiting wrap 134 has a thickness greater than a thickness of the fixed wrap 144, the orbiting wrap 134 may be elongated in a counterclockwise direction. That is, the outer end 134*a* of the orbiting wrap 134 of FIG. 4A may be provided at a position that extends further than the outer end 134*a* of the orbiting wrap 134 of FIG. 4B in the counterclockwise direction.

FIG. 5 illustrates a view for comparing a shape $W_1$ of the orbiting wrap 134 when the orbiting wrap 134 and the fixed wrap 144 have the same thickness to a shape of the orbiting wrap 134 when the orbiting wrap 134 has a thickness greater than a thickness of the fixed wrap 144. Referring to FIG. 5, it is seen that the orbiting wrap 134 further extends in the counterclockwise direction when compared to the shape $W_1$. In summary, an angle at which the orbiting wrap 134 according to this embodiment spirally extends from the inner start end 134*b* to the outer end 134*a*, that is, a wrap angle may be greater by an angle, a than a wrap angle for the shape $W_1$.

As the wrap angle increases, after the refrigerant is suctioned into the compression chamber, a rotational amount (angle) to which the compression chamber is capable of spirally rotating toward the inner start end 134*b*, 144*b* of each of the wraps 134 and 144 may increase. As a result, to generate a predetermined discharge pressure while a compression stroke is performed, a degree of compression due to rotation of the compression chamber, that is, a compression gradient may be reduced. As a result, a compression load of the compressor may be reduced, improving efficiency.

Referring to FIG. 6, a first wrap angle $\Phi_p$ may be defined when the orbiting wrap 134 and the fixed wrap 144 have the same thickness according to the related art, and a second wrap angle $\Phi_c$ may be defined, when the orbiting wrap 134 has a thickness greater than a thickness of the fixed wrap 144 according to this embodiment. After suction of the refrigerant is completed, a stroke volume that varies until the refrigerant is discharged through the discharge hole 145 may correspond to a stroke volume $V_1$. The stroke volume may refer to a volume that varies when a process from suction to discharge of the refrigerant is performed as one stroke.

Reference symbol $L_1$ represents a degree of compression to reach the stroke volume $V_1$ when the first wrap angle $\Phi_p$ is defined according to the related art. $L_1$ may be defined by a compression gradient $S_1$. Reference symbol $L_2$ represents a degree of compression to reach the stroke volume $V_1$ when the second wrap angle $\Phi_c$ is defined according to this embodiment. $L_2$ may be defined by a compression gradient $S_2$.

That is, it is seen that the compression gradient $S_2$ when the second wrap angle $\Phi_c$ is defined according to this embodiment is less than the compression gradient $S_1$ when the first wrap angle Φp is defined according to the related art. Thus, as described above, the compression load of the scroll compressor may be reduced, improving compression efficiency.

Figure 7:
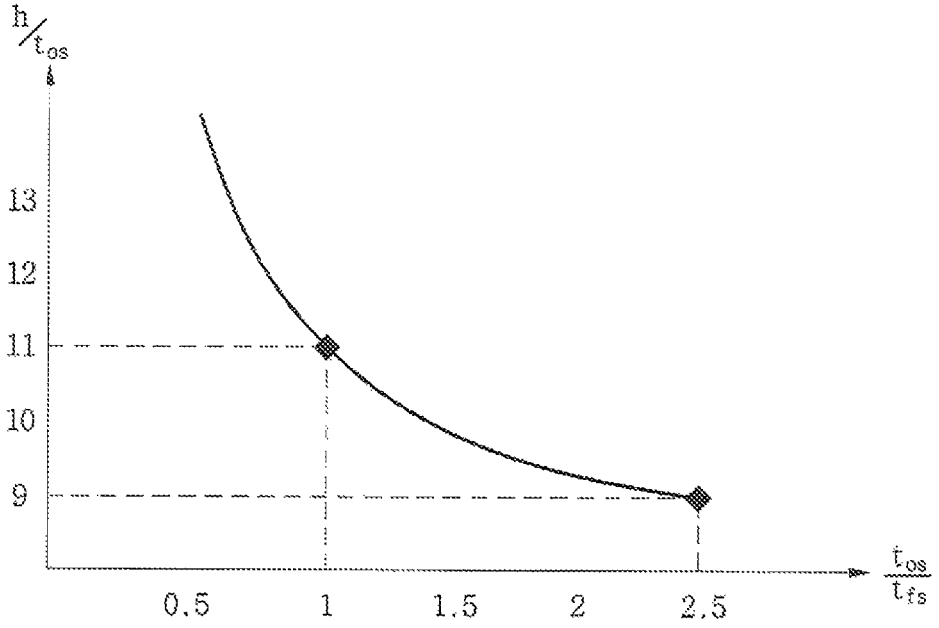
FIG. 7 is a graph illustrating a ratio of a thickness of the first wrap of the orbiting scroll to a thickness of the second wrap of the fixed scroll and a relationship in ratio of a height of the first wrap to the thickness of the first wrap according to an embodiment.
Figure 8:
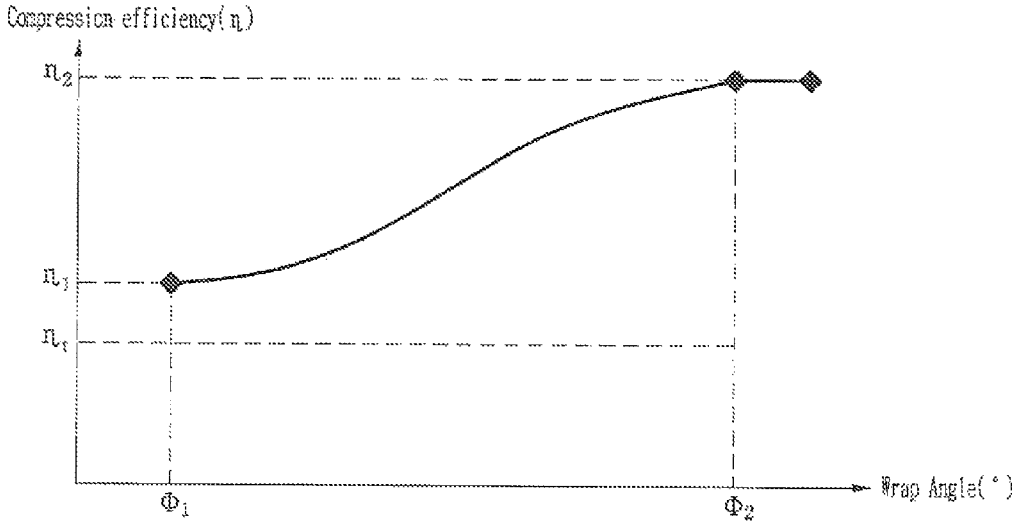
FIG. 8 is a graph illustrating a variation in compression efficiency due to wrap angle according to an embodiment.

FIG. 7 is a graph illustrating a ratio of a thickness of the first wrap of the orbiting scroll to a thickness of the second wrap of the fixed scroll and a relationship in ratio of a height of the first wrap to a thickness of the first wrap according to an embodiment. FIG. 8 is a graph illustrating a variation in compression efficiency due to wrap angle according to an embodiment.

Referring to FIG. 7, a horizontal axis in the graph represents a ratio of a thickness $t_{os}$ of the orbiting wrap 134 to a thickness $t_{fs}$ of the fixed wrap 144, and a vertical axis represents a ratio of a height h of each of the wraps 134 and 144 to a thickness $t_{os}$ of the orbiting wrap 134. The height h of the fixed wrap 144 and the height h of the orbiting wrap 134 may be the same.

A ratio of the height h of each of the wraps 134 and 144 to the thickness $t_{os}$ of the orbiting wrap 134 with respect to a preset or predetermined size of the scroll compressor may range from about 9 to about 11. For example, with respect to the size of the scroll compressor, the first head plate 133 of the orbiting scroll 130 may have a diameter of about 114 mm. The thickness $t_{os}$ of the orbiting wrap 134 may refer to a thickness of the outer end 134*a*.

In a case in which the ratio $h/t_{os}$ is less than about 9, it may be difficult to satisfy a required level of compression capacity because the height h is relatively low. In a case in which the ratio $h/t_{os}$ is greater than about 11, vibration may occur because the height h is relatively large, causing unstable behavior, thereby having a bed influence on rigidity.

As described above, to secure the rigidity of the orbiting scroll 130, the thickness $t_{os}$ of the orbiting wrap 134 may have a predetermined value or more. For example, in this embodiment, the orbiting wrap 134 may have a thickness $t_{os}$ of about 4 mm.

In this design condition, to satisfy a range of the ratio $h/t_{os}$, the height h may have a value within a predetermined range. Also, the thickness $t_{fs}$ of the fixed wrap 144 may be determined to be within a range which is allowable within the predetermined range of the height h. As the fixed scroll 144 is stably supported by the main frame 120, the thickness of the fixed wrap 144 may not be relatively largely restricted when compared to the thickness of the orbiting wrap 134. Thus, the allowable thickness $t_{fs}$ of the fixed wrap 144 may be determined according to the predetermined height h.

The graph of FIG. 7 may be determined according to variation in thickness $t_{fs}$ and height h of the fixed wrap 144. Thus, in this embodiment, the range of the thickness ratio $t_{os}/t_{fs}$ which is capable of satisfying the design condition may be determined. For example, the thickness ratio $t_{os}/t_{fs}$ according to this embodiment may be determined within a range of about 1 to about 2.5.

When the ratio of $h/t_{os}$ is about 11, the thickness ratio $t_{os}/t_{fs}$ may be about 1. When the ratio of $h/t_{os}$ is about 9, the thickness ratio $t_{os}/t_{fs}$ may be about 2.5.

FIG. 8 illustrates a state in which compression efficiency η varies according to a variation in wrap angle Φ. The compression efficiency may be improved as the wrap angle is increased. The wrap angle may be determined according to the ratio $t_{os}/t_{fs}$ of thickness $t_{os}$ of the orbiting wrap 134 to thickness $t_{fs}$ of the fixed wrap 144. When the thickness ratio $t_{os}/t_{fs}$ ranges from about 1 to about 2.5, the wrap angle may range from an angle $\Phi_1$ to an angle $\Phi_2$. For example, the angle $\Phi_1$ may be about 800°, and the angle $\Phi_2$ may be about 1,200°.

For the angle $\Phi_1$, the compression efficiency may be $\eta_1$. For the angle $\Phi_2$, the compression efficiency may be $\eta_2$. Also, the compression efficiency $\eta_2$ may be greater than the compression efficiency $\eta_1$. The compression efficiency $\eta_1$ may be greater than a required compression efficiency $\eta_t$. Also, when the wrap angle is greater than the angle $\Phi_2$, the compression efficiency scarcely increases.

As a result, according to this embodiment, the orbiting wrap 134 has a thickness greater than a thickness of the fixed wrap 144. The thickness ratio $t_{os}/t_{fs}$ at the outer end may be within the preset or predetermined range. Thus, as illustrated in FIG. 7, the ratio of thickness $t_{os}$ of each of the wraps 134 and 144 to thickness $t_{os}$ of the orbiting wrap 134 may be within the required range.

Also, as illustrated in FIG. 8, the predetermined wrap angle range may be satisfied, and the compression efficiency which is capable of being achieved according to the wrap angle range may be above a preset or predetermined compression efficiency.

According to the embodiments disclosed herein, the first wrap of the orbiting scroll may have a thickness $t_{os}$ thicker than a thickness $t_{fs}$ of the second wrap of the fixed scroll to increase an angle of the end (hereinafter, referred to as a "wrap angle") of the first or second wrap, thereby increasing a stroke volume of the scroll compressor and improving volume efficiency. For a preset or predetermined size of the scroll compressor, as the ratio of thickness to of the first wrap to the thickness $t_{fs}$ of the second wrap is in a predetermined range, the ratio of height to thickness of the first wrap may be within a desired value or range.

Further, as the ratio of height to thickness of the first wrap is in the desired value or range, unstable movement or vibration of the first wrap while the scroll compressor is driven may be prevented to satisfactorily maintain a rigidity of the first wrap. Furthermore, as an optimized wrap angle is suggested for the preset or predetermined size of the scroll compressor, unnecessary material and processing costs may be reduced, improving compression efficiency of the scroll compressor.

Embodiments disclosed herein provide a scroll compressor having improved compressor efficiency.

Embodiments disclosed herein provide a scroll compressor that may include a casing including a rotational shaft; a first scroll rotated by rotation of the rotational shaft, the first scroll including a first head plate and a first wrap that extends from the first head plate in one or a first direction; and a second scroll that defines a plurality of compression chambers together with the first scroll, the second scroll including a second head plate and a second wrap that extends from the second head plate in the other or a second direction. Each of the first and second wraps may spirally extend from an outer end toward an inner start end, and the first wrap may have a thickness greater than a thickness of the second wrap.

Each of the first and second wraps may have a thickness that gradually increases from the outer end to the inner start end. The outer end of the first wrap may have a thickness greater than a thickness of the second wrap. The inner start end of the first wrap may have a same thickness as the thickness of the second wrap.

A ratio ($h/t_{os}$) of height (h) to which the first wrap extends from the first head plate toward the second head plate may have a value of about 9 to about 11 with respect to the thickness ($t_{os}$) of the outer end of the first wrap. A wrap angle at which the first wrap extends from the inner start end to the outer end thereof may range from about 800° to about 1,200°. A ratio ($t_{os}/t_{fs}$) of thickness to of the outer end of the first wrap to thickness $t_{fs}$ of the outer end of the second wrap may have a value of about 1 to about 2.5 according to the ratio ($h/t_{os}$).

The outer end may be an end, which may be disposed or provided at a refrigerant suction side, of both ends of the first or second wrap, and the inner start end may be an end, which may be provided at a refrigerant discharge side, of both ends of the first or second wrap. The first wrap may have a same vertical height as a vertical height of the second wrap.

The casing may have a suction space (S) and a discharge space (D), and a discharge cover that partitions an inner space into the suction space (S) and the discharge space (D) may be disposed or provided in an inner upper portion of the casing.

The scroll compressor may further include an intermediate pressure discharge hole defined in the second head plate of the second scroll to transfer a refrigerant of the compression chamber having an intermediate pressure into a back pressure chamber. The scroll compressor may further include a back pressure chamber assembly that defines the back pressure chamber. The back pressure assembly may include a back pressure plate disposed or provided on the second head plate, and a floating plate separably coupled to the back pressure plate to vertically move, and the back pressure chamber may be defined as an inner space of the back pressure plate and the floating plate.

According to embodiments disclosed herein, a scroll compressor is provided that may include a casing including a rotational shaft; a first scroll rotating by rotation of the rotational shaft, the first scroll including a first wrap having a logarithmic spiral shape; and a second scroll that defines a plurality of compression chambers together with the first scroll, the second scroll including a second wrap having the logarithmic spiral shape. The first wrap may have a thickness ($t_{os}$) greater by a set ratio than that ($t_{fs}$) of the second wrap. The set ratio may have a value of about 1 to about 2.5.

The first wrap and the second wrap may have the same height (h), and a ratio of height (h) of the first wrap to thickness ($t_{os}$) of the first wrap may have a value of about 9 to about 11. A wrap angle at which the first wrap extends from an inner start end to an outer end thereof may range from about 800° to about 1,200°.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing including a rotational shaft;

a first scroll rotated by rotation of the rotational shaft and including a first head plate and a first wrap that extends from the first head plate in a first direction; and a second scroll that defines a plurality of compression chambers together with the first scroll and including a second head plate and a second wrap that extends from the second head plate in a second direction, wherein each of the first wrap and the second wrap spirally extends from an outer end portion toward an inner start end portion and has a thickness that gradually increases from the outer end portion to the inner start end portion, wherein:

the outer end portion of the first wrap has a first thickness greater than a second thickness of the outer end portion of the second wrap, the inner start end portion of the first wrap has a same thickness as the thickness of the inner start end portion of the second wrap, a first ratio of a height to which the first wrap extends from the first head plate toward the second head plate with respect to the first thickness of the outer end portion of the first wrap has a value of about 9 to about 11, and a second ratio of the first thickness of the outer end portion of the first wrap to the second thickness of the outer end portion of the second wrap has a value of about 1 to about 2.5 the first ratio, and a wrap angle at which the first wrap extends from the inner start end portion to the outer end portion thereof ranges from about 800° to about 1,200°.

2. The scroll compressor according to claim 1, wherein the outer end portions of both the first wrap and the second wrap include a first end and a second end, which is provided at a refrigerant suction side, and the inner start end portions of both the first wrap and the second wrap include a first end and a second end, which is provided at a refrigerant discharge side.

3. The scroll compressor according to claim 1, wherein the first wrap has a same vertical height as a vertical height of the second wrap.

4. The scroll compressor according to claim 1, wherein the casing has a suction space and a discharge space thereinside, and wherein a discharge cover that partitions an inner space into the suction space and the discharge space is provided in an inner upper portion of the casing.

5. The scroll compressor according to claim 1, further including an intermediate pressure discharge hole defined in the second head plate of the second scroll to transfer a refrigerant of a compression chamber of the plurality of compression chambers having an intermediate pressure into a back pressure chamber.

6. The scroll compressor according to claim 5, further including a back pressure chamber assembly that defines the back pressure chamber, wherein the back pressure chamber assembly includes a back pressure plate provided on the second head plate and a floating plate separably coupled to the back pressure plate to move in a vertical direction, and wherein the back pressure chamber is defined as an inner space of the back pressure plate and the floating plate.

* * * * *